US011808105B2

(12) United States Patent
Tonti et al.

(10) Patent No.: US 11,808,105 B2
(45) Date of Patent: Nov. 7, 2023

(54) DOWNHOLE TOOL WITH SEAL RING AND SLIPS ASSEMBLY

(71) Applicant: INNOVEX DOWNHOLE SOLUTIONS, INC., Houston, TX (US)

(72) Inventors: Nick Tonti, Houston, TX (US); Jeffery Kitzman, Houston, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 214 days.

(21) Appl. No.: 17/237,296

(22) Filed: Apr. 22, 2021

(65) Prior Publication Data

US 2021/0332661 A1 Oct. 28, 2021

Related U.S. Application Data

(60) Provisional application No. 63/015,216, filed on Apr. 24, 2020.

(51) Int. Cl.

| | |
|---|---|
| ***E21B 33/12*** | (2006.01) |
| ***E21B 33/129*** | (2006.01) |
| ***E21B 33/128*** | (2006.01) |
| ***E21B 34/14*** | (2006.01) |
| ***E21B 23/01*** | (2006.01) |

(52) U.S. Cl.

CPC ..... *E21B 33/129* (2013.01); *E21B 23/01* (2013.01); *E21B 33/128* (2013.01); *E21B 34/142* (2020.05); *E21B 2200/08* (2020.05)

(58) Field of Classification Search

CPC .... E21B 33/129; E21B 33/128; E21B 34/142; E21B 23/01; E21B 2200/08

See application file for complete search history.

(56) References Cited

U.S. PATENT DOCUMENTS

| | | | | |
|---|---|---|---|---|
| 6,354,372 | B1 * | 3/2002 | Carisella | E21B 33/1216 166/134 |
| 2008/0223586 | A1 * | 9/2008 | Barnett | E21B 23/04 166/325 |
| 2017/0370176 | A1 | 12/2017 | Frazier | |
| 2019/0153808 | A1 * | 5/2019 | Hardesty | E21B 33/129 |
| 2020/0040680 | A1 * | 2/2020 | Mhaskar | E21B 23/01 |
| 2020/0157914 | A1 * | 5/2020 | Graham | E21B 43/26 |
| 2020/0355040 | A1 * | 11/2020 | Li | E21B 33/134 |

FOREIGN PATENT DOCUMENTS

| | | | |
|---|---|---|---|
| CN | 103982158 | A | 8/2014 |
| WO | 2017177227 | A1 | 10/2017 |

OTHER PUBLICATIONS

Bahng, Seung Hoon (Authorized Office), International Search Report and Written Opinion dated Jul. 21, 2021, PCT Application No. PCT/US2021/028572, 11 pages.

* cited by examiner

*Primary Examiner* — Christopher J Sebesta
(74) *Attorney, Agent, or Firm* — MH2 TECHNOLOGY LAW GROUP LLP

(57) ABSTRACT

A downhole tool includes a slips assembly, a cone positioned at least partially within the slips assembly, the cone being configured to move axially relative to the slips assembly such that the cone presses the slips assembly radially outward and into engagement with a surrounding tubular in which the downhole tool is deployed, and a seal ring positioned around the cone, the seal ring being configured to be pressed radially outward by engagement with the cone and into engagement with the surrounding tubular.

16 Claims, 10 Drawing Sheets

DOWNHOLE TOOL WITH SEAL RING AND SLIPS ASSEMBLY

CROSS-REFERENCE TO RELATED APPLICATIONS

This application claims priority to U.S. Provisional Patent Application No. 63/015,216, which was filed on Apr. 24, 2020, and is incorporated herein by reference in its entirety.

BACKGROUND

There are various methods by which openings are created in a production liner for injecting fluid into a formation. In a "plug-and-perf" frac job, the production liner is made up from standard lengths of casing. Initially, the liner does not have any openings through its sidewalls. The liner is installed in the wellbore, either in an open bore using packers or by cementing the liner in place, and the liner walls are then perforated. The perforations are typically created by perforation guns that discharge shaped charges through the liner and, if present, adjacent cement.

The production liner is typically perforated first in a zone near the bottom of the well. Fluids are then pumped into the well to fracture the formation in the vicinity of the perforations. After the initial zone is fractured, a plug is installed in the liner at a position above the fractured zone to isolate the lower portion of the liner. The liner is then perforated above the plug in a second zone, and the second zone is fractured. This process is repeated until all zones in the well are fractured.

The plug-and-perf method is widely practiced, but it has a number of drawbacks, including that it can be extremely time consuming. The perforation guns and plugs are generally run into the well and operated individually. After the frac job is complete, the plugs are removed (e.g., drilled out) to allow production of hydrocarbons through the liner.

SUMMARY

Embodiments of the disclosure include a downhole tool. The downhole tool includes a slips assembly, and a cone positioned at least partially within the slips assembly. The cone is configured to move axially relative to the slips assembly such that the cone presses the slips assembly radially outward and into engagement with a surrounding tubular in which the downhole tool is deployed. The downhole tool also includes a seal ring positioned around the cone. The seal ring is configured to be pressed radially outward by engagement with the cone and into engagement with the surrounding tubular.

Embodiments of the disclosure also include an assembly including a downhole tool and a setting tool. The downhole tool includes a slips assembly, and a cone received at least partially into the slips assembly. The cone is tapered such that moving the cone relative to the slips assembly causes the cone to press the slips assembly radially outward into engagement with a surrounding tubular into which downhole tool is deployed. The downhole tool also includes a seal ring received around the cone. The seal ring is configured to be pressed radially outward into engagement with the surrounding tubular by engagement with the cone. The setting tool includes a setting sleeve that is configured to apply an axial force onto the downhole tool that forces the cone to advance axially into the slips assembly, so as to press the slips assembly and the seal ring radially outward into engagement with the surrounding tubular.

Embodiments of the disclosure further include a method that includes connecting a setting rod of a setting tool to a shoe of a downhole tool. A setting sleeve of the setting tool engages a slips ring of the downhole tool, the slips ring being positioned around a cone of the downhole tool. The method also includes deploying the setting tool and the downhole tool into a well, and setting the downhole tool in the well using the setting tool. Setting the downhole tool includes pressing a first taper of the cone into a slips assembly of the downhole tool by applying an axial force to the slips ring. Applying the axial force to the slips ring causes the first taper of the cone to press the slips assembly radially outward. Applying the axial force also causes the slips ring to slide along a second taper of the cone, toward the slips assembly, so as to press the slips ring radially outward. Applying the axial force further causes a seal ring to slide along the first taper of the cone, so as to press the seal ring radially outward.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
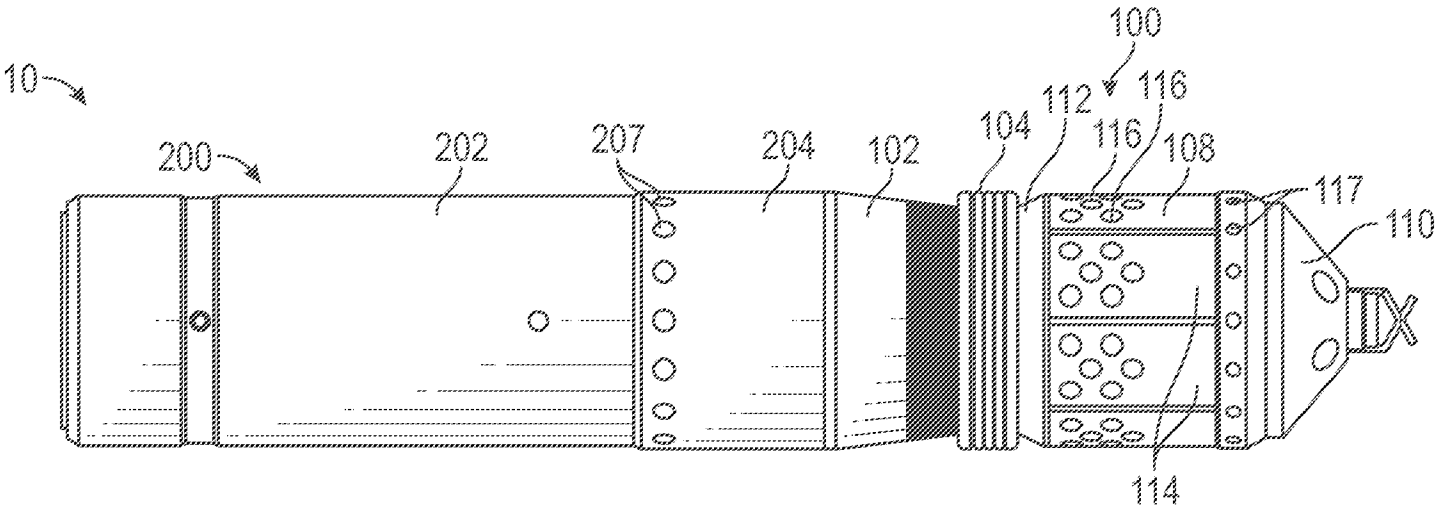
FIG. 1 illustrates a side view of an assembly of a downhole tool and a setting tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side view of an assembly 10 of a downhole tool 100 and a setting tool 200, according to an embodiment. The downhole tool 100 may generally include a cone 102, a seal ring 104, a slips assembly 108, and a shoe 110. The seal ring 104 and the slips assembly 108 are received around the cone 102. The seal ring 104 and the slips assembly 108 may not be directly coupled together, at least initially, but may be held in place with respect to one another via their respective engagements with the cone 102. Further, the seal ring 104 may be positioned uphole of the slips assembly 108 and may have an axial length that is between about 1/10 and about 1/3 of the axial length of the cone 102 and/or of the slips assembly 108.

The cone 102 has a tapered shape and is movable with respect to the slips assembly 108, the seal ring 104, and the shoe 110 by engagement with the setting tool 200. Moving the cone 102 farther into the slips assembly 108 and through the seal ring 104 may press the slips assembly 108 and seal ring 104 radially outwards, e.g., into engagement with a surrounding tubular.

The slips assembly 108 may further include a band 112, which may be received around an axial end of the slips assembly 108, as shown. The band 112 may be generally wedge-shaped, in some embodiments, with a tapered-down end facing the seal ring 104. Accordingly, in at least some embodiments, the seal ring 104 may be pressed into axial engagement with the slips assembly 108, specifically the band 112, which may drive the seal ring 104 radially outward, e.g., into sealing engagement with a surrounding tubular.

The slips assembly 108 may also include a plurality of circumferentially-adjacent slips segments 114. The slips segments 114 may be initially held together, e.g., via the band 112 and the shoe 110, as will be described in greater detail below. The slips segments 114 may be otherwise coupled together as well, e.g., by frangible or other temporary connections therebetween. The slips segments 114 may be made of a relatively soft, dissolvable material, such as magnesium or a dissolvable composite, or a soft, non-dissolvable material such as a composite material (e.g., fiber-reinforced material). Accordingly, to anchor into a surrounding (e.g., steel) tubular, the slips segments 114 may each include one or more inserts or "buttons" 116, which may be made from a ceramic or carbide and are oriented and/or otherwise configured to bite into the surrounding tubular when the slips assembly 108 is pressed radially outwards into engagement therewith.

The shoe 110 may be releasably coupled to the slips assembly 108 and may be configured to bear axially against the slips assembly 108, opposite to the cone 102. Accordingly, the shoe 110 serves to retain the position of the downhole tool 100 during setting, as will be described in greater detail below. The shoe 110 may be made of a relatively soft, dissolvable material, such as magnesium, or a soft, non-dissolvable material such as a composite material (e.g., fiber-reinforced material). In some embodiments, a dissolvable composite could be used. The shoe 110 may also include a plurality of (e.g., carbide or ceramic) inserts or "buttons" 117, which may extend radially outwards of the slips assembly 108, thereby protecting the relatively soft material of the slips assembly 108, the shoe 110, or any other components of the downhole tool 100 from abrasion against the surrounding tubular during run in.

The setting tool 200 includes an outer setting sleeve 202, which has an end that bears axially against the cone 102, so as to transmit a force thereto and cause the cone 102 to move with respect to the slips assembly 108 and the seal ring 104. In an embodiment, the setting sleeve 202 includes a radially-enlarged portion 204, proximal to (e.g., extending from) where the setting sleeve 202 engages the cone 102. The radially-enlarged portion 204 may extend to a radial position that is at least as far from a central axis of the assembly 10 as the cone 102. One or more inserts or "buttons" 207 may be embedded at least partially in the radially-enlarged portion 204. The inserts 207 may be formed from a material, such as carbide or ceramic, that is harder than the material of the rest of the setting sleeve 202, the cone 102, and/or the slips assembly 108 (except for the inserts 116). The cone 102 may be made of a relatively soft, dissolvable material, such as magnesium, or a soft, non-dissolvable material such as a composite material (e.g., fiber-reinforced material). In some embodiments, a dissolvable composite could be used. Accordingly, the inserts 207 may protect the cone 102, slips assembly 108, and/or other components of downhole tool 100 from abrasion against the surrounding tubular during run-in.

Figure 7:
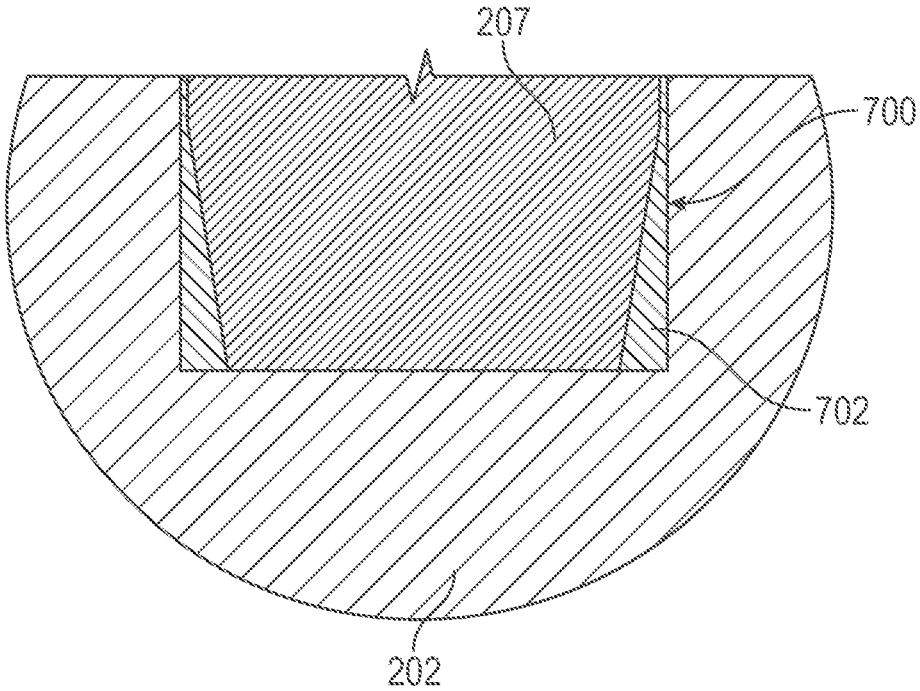
FIG. 7 illustrates a side, cross-sectional view of an insert of the setting tool, according to an embodiment.

FIG. 7 illustrates an enlarged, cross-sectional view of an example of the inserts 207 in the setting sleeve 202 of the setting tool 200. As shown, the insert 207 may be tungsten carbide, although other sufficiently hard materials may be employed. The insert 207 is received into a hole 700 formed in the setting sleeve 202. The insert 207 may be brazed in place in the hole 700, e.g., using a metal filler and flux 702.

Further, as shown, the insert 207 may extend to at least the same radial position as the outer diameter surface of the setting sleeve 202.

Figure 2:
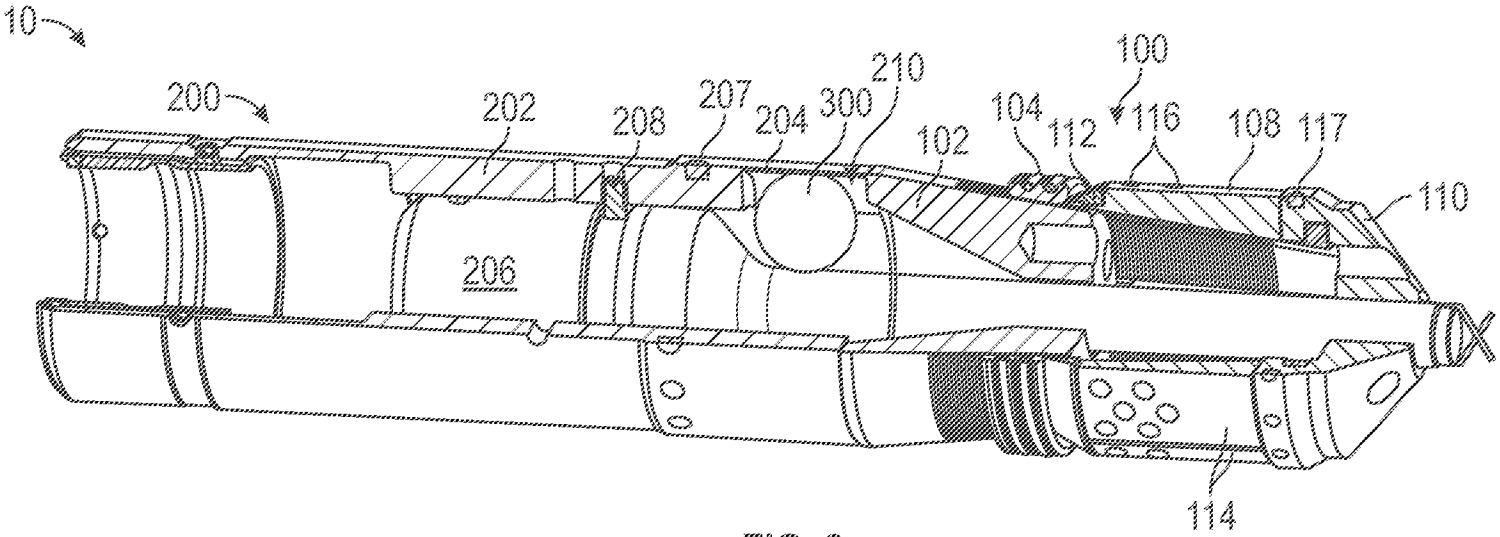
FIG. 2 illustrates a quarter-sectional, perspective view of the assembly of FIG. 1, according to an embodiment.

Referring now to FIG. 2, a partial sectional view of the assembly 10 is provided, which illustrates an example of the internal components thereof. In particular, the setting tool 200 may include a setting rod 206, which may extend from within the setting sleeve 202, through the cone 102 and slips assembly 108, and into connection with the shoe 110. The connection between the shoe 110 and the setting rod 206 may be releasable (e.g., via yielding at a predetermined force). Further, the setting rod 206 may be initially prevented from movement with respect to the setting sleeve 202 by one or more shearable members 208, e.g., pins or screws, which may prevent premature setting of the downhole tool 100 during run in. During setting, the shearable members 208 shear and release the setting rod 206 to move independently of the setting sleeve 202.

An obstruction member 300 may be positioned within the setting sleeve 202, e.g., in a storage pocket 210 formed in the radially-enlarged portion 204 thereof. The obstruction member 300 may be initially retained in position within the setting sleeve 202 by engagement with the setting rod 206 and the cone 102; however, after setting the downhole tool 100, the setting rod 206 may be released from the shoe 110, and the setting tool 200 pulled away from the downhole tool 100. This may allow the obstruction member 300 to drop out of the setting sleeve 202, e.g., propelled by fluid flow, and be received into a valve seat formed in a bore of the cone 102.

Figure 3:
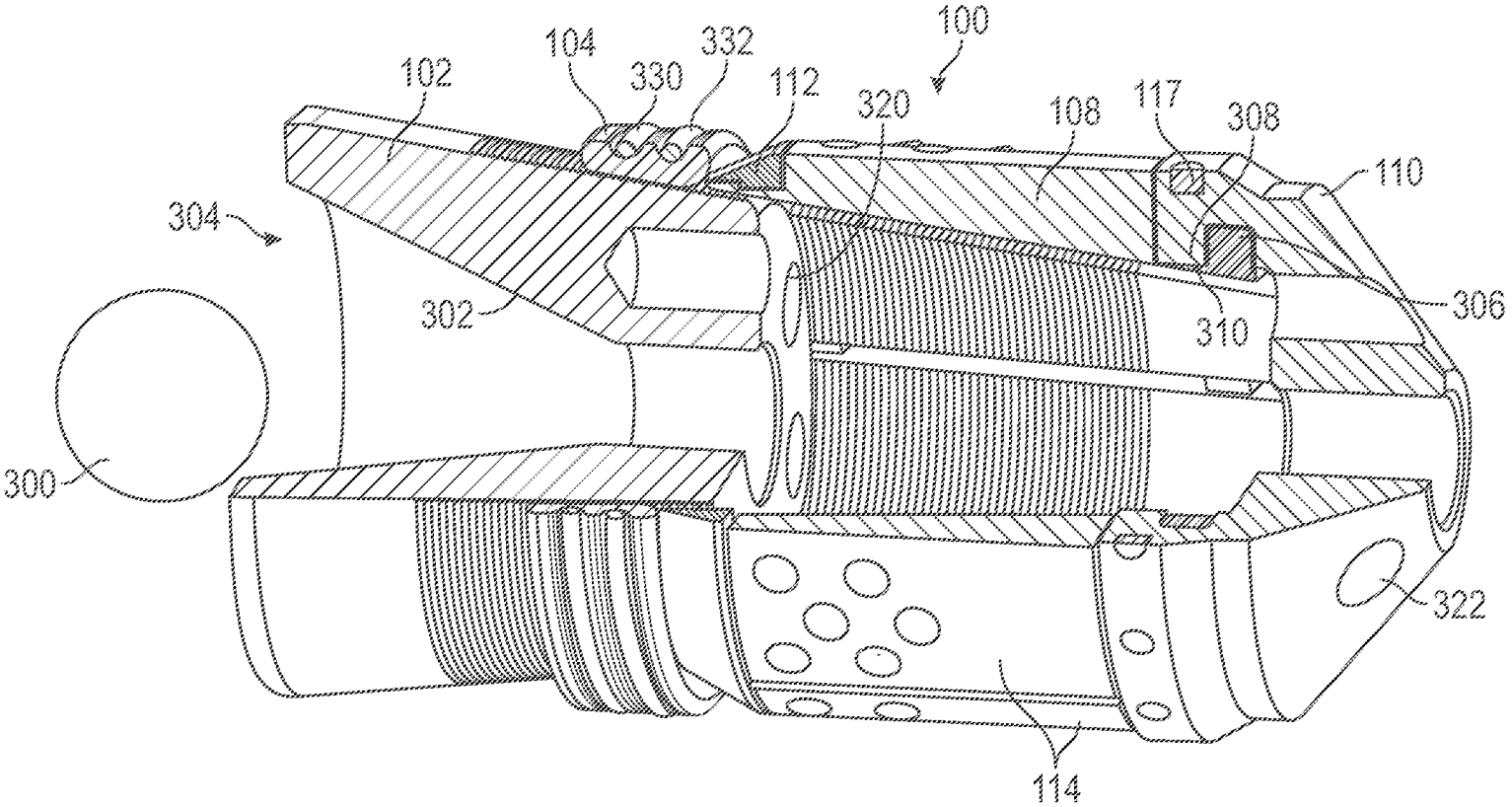
FIG. 3 illustrates a quarter-sectional, perspective view of the downhole tool, according to an embodiment.

FIG. 3 illustrates an enlarged, quarter-sectional view of the downhole tool 100 along with the obstruction member 300, and without the setting tool 200, which is omitted for the sake of clarity from this view, according to an embodiment. As mentioned above, the obstruction member 300 may be configured to engage a valve seat 302 formed in a bore 304 of the cone 102. This occurs after setting the downhole tool 100 in the well, as will be described in greater detail below, and serves to block fluid communication through the downhole tool 100 and thus through the well, at least temporarily.

As also shown, the shoe 110 is detachably coupled to the slips assembly 108, in particular, such that pressing the slips assembly 108 radially outwards releases the slips assembly 108 from the shoe 110. For example, the slips assembly 108 may include a first interlocking member 306, which may receive a second interlocking member 308 of the shoe 110. A reduced-thickness (or otherwise reduced strength, or even adhered/epoxied) region 310 may be defined in the slips assembly 108, extending from the first interlocking member 306. Upon pressing the slips assembly 108 radially outwards, the reduced-thickness region 310 may break, separating the first interlocking member 306 from the rest of the slips assembly 108, and releasing the shoe 110 from the slips assembly 108.

As also visible in FIG. 3, the cone 102 and/or the shoe 110 may include holes 320, 322. The holes 320, 322 may serve to house items (e.g., acid pills) or to permit for greater surface area, e.g., to promote the cone 102 and shoe 110 dissolving in the well.

Further, one or more seals 330, 332 may be positioned along the outer surface of the seal ring 104. The seals 330, 332 may be o-rings, and may be configured to seal with a surrounding tubular. In one embodiment, the seals 330, 332 may be elastomeric. In another embodiment, the seals 330, 332 may be configured to dissolve in the downhole, wellbore environment. For example, the seals 330, 332 may be made from polyglycolide (PGA). In some embodiments, a metal-to-metal seal between the seal ring 104 and the surrounding tubular may be sufficient such that the seals 330, 332 may be omitted. Additionally, the seal ring 104 may be undercut, e.g., defining a radiused or beveled edge between the axial face thereof that is closest to the band 112 and the inner diameter surface thereof. This may facilitate the seal ring 104 being wedged radially outwards by the band 112, e.g., allowing the band 112 to be wedged at least partially between the cone 102 and the seal ring 104.

Figure 4:
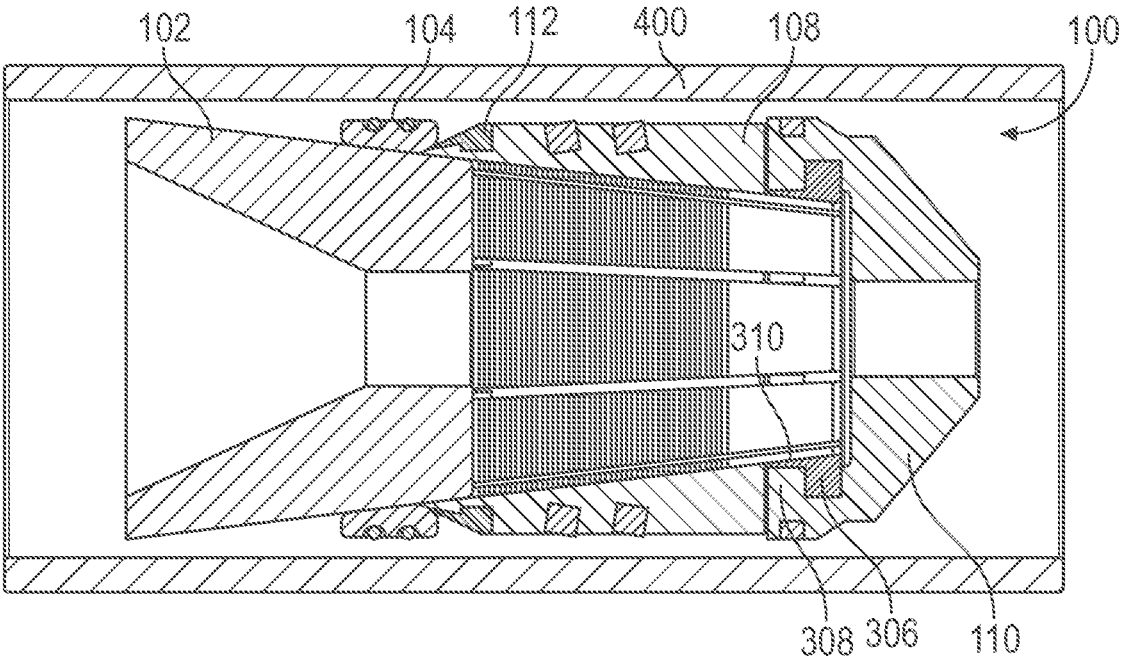
FIG. 4 illustrates a side view of the downhole tool deployed into a well in a run-in configuration, according to an embodiment.

FIG. 4 illustrates the downhole tool 100 deployed into the well (e.g., a surrounding tubular 400 such as casing) and in a run-in configuration. Generally, in the run-in configuration, the setting tool 200 is attached to the downhole tool 100; however, the setting tool 200 is omitted from this view for ease of viewing the downhole tool 100. The cone 102 may be received partially into the slips assembly 108 and through the seal ring 104. The shoe 110 may be coupled to the slips assembly 108, e.g., via the releasable interlocking members 306, 308 discussed above. To set the downhole tool 100, a downward force is applied to the setting sleeve 202, while an upward force is applied to the setting rod 206. This downward force on the setting sleeve 202 is transmitted to the cone 102, and the upward force of the setting rod 206 is transmitted to the shoe 110. As a consequence, the cone 102 is forced to advance into the slips assembly 108, toward the shoe 110. The tapered shape of the cone 102 thus causes the seal ring 104 and the slips assembly 108 to be driven radially outwards, toward engagement with the surrounding tubular 400.

Figure 5:
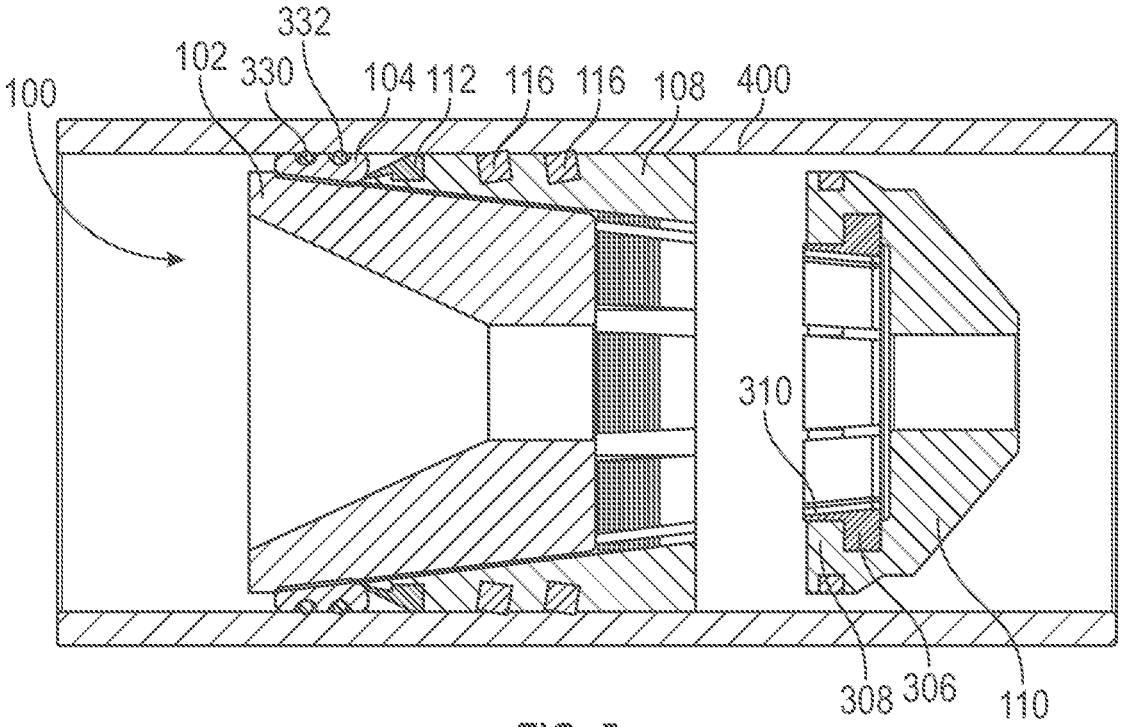
FIG. 5 illustrates a side view of the downhole tool deployed into the well in a set configuration, according to an embodiment.
Figure 6:
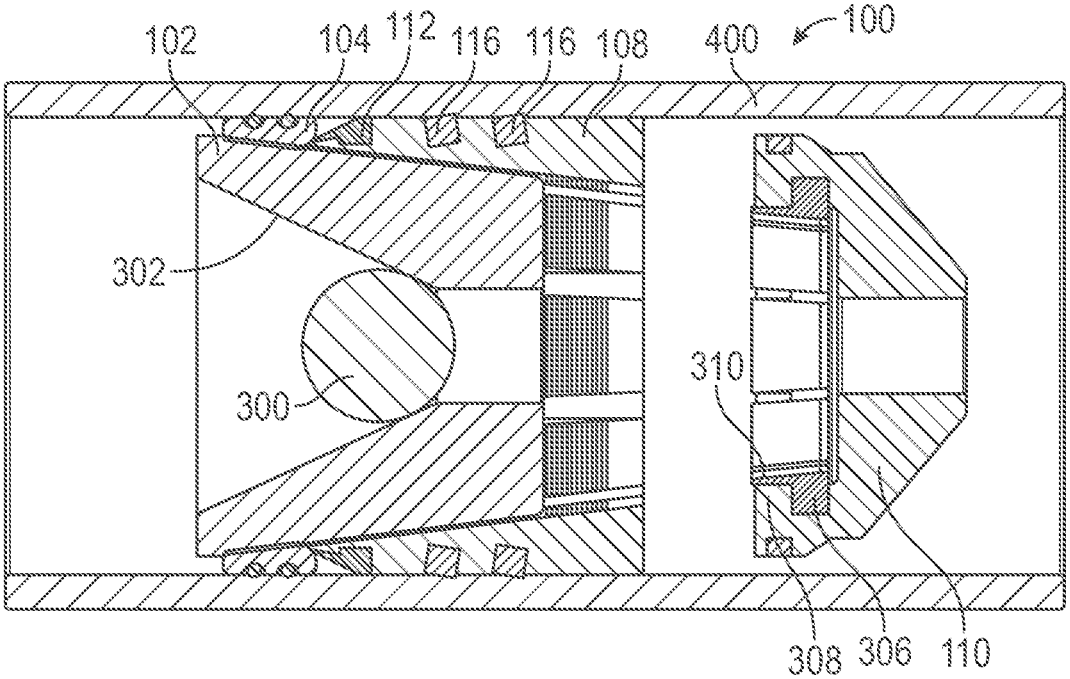
FIG. 6 illustrates a side view of the downhole tool in the set configuration with a ball seated in a valve seat of the downhole tool, according to an embodiment.

At some point, after engagement with the surrounding tubular 400 is accomplished, as shown in FIG. 5, the setting forces may exceed the strength of the connection between the shoe 110 and the setting rod 206, and the setting rod 206 releases from the shoe 110. This is referred to as the set configuration of the downhole tool 100. In this configuration, the seal ring 104 may be pressed into at least partial sealing engagement with the surrounding tubular 400, e.g., the seals 330, 332 may sealingly engage the tubular 400, and the seal ring 104 may be pressed at least partially up the wedge-shaped band 112, e.g., by the axial-component of the force of the cone 102 being driven therethrough. As mentioned above, forcing the slips assembly 108 radially outwards breaks the connection with the shoe 110, and after the setting rod 206 is withdrawn, the shoe 110 then falls away from the remainder of the tool 100. As shown in FIG. 6, the obstruction member 300 may then be received into the cone 102 and may engage and seal with the valve seat 302 thereof, thereby preventing fluid flow through the tool 100, and thus through the surrounding tubular 400, until the tool 100 dissolves, is drilled out, or is otherwise removed.

Figure 8:
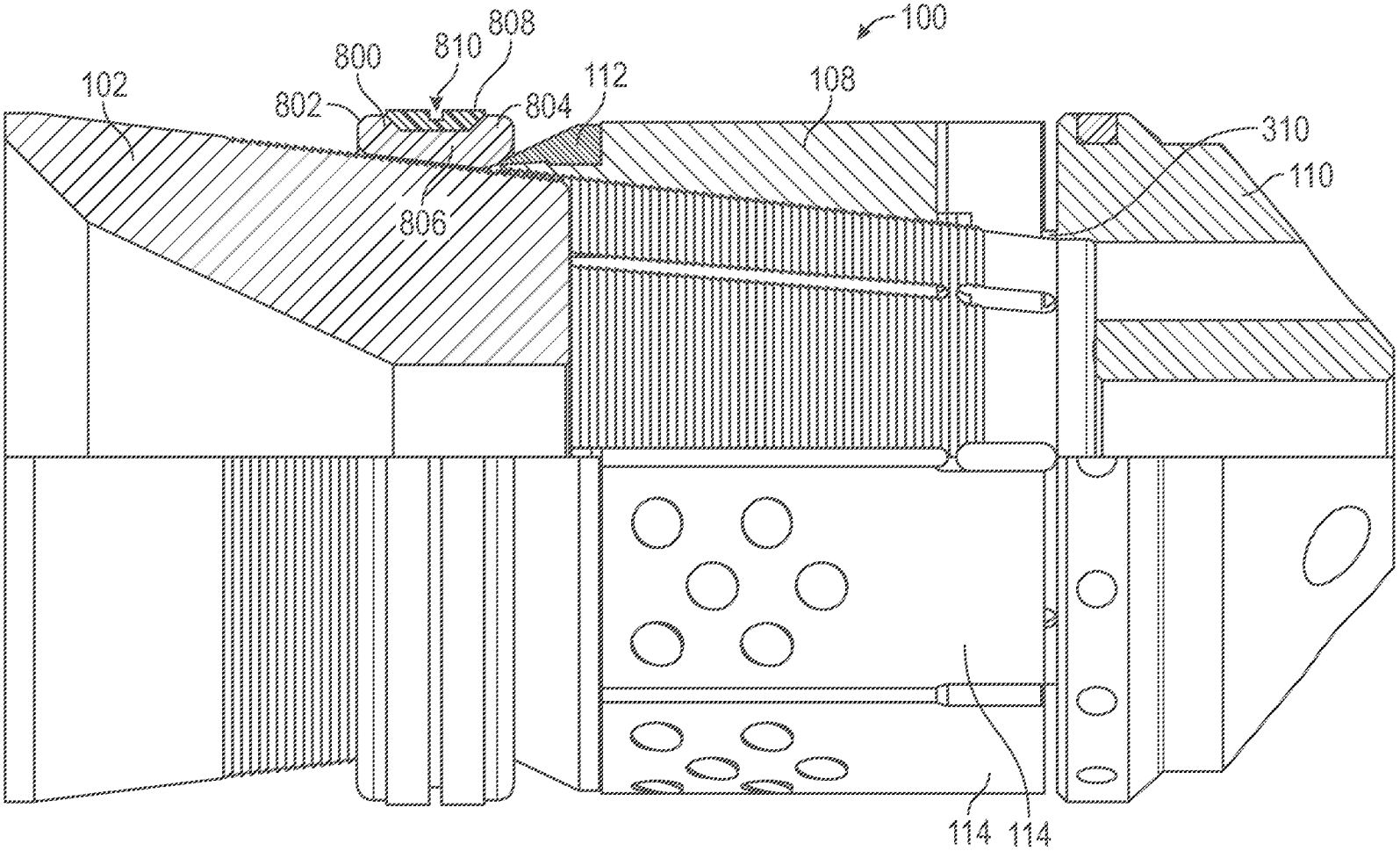
FIG. 8 illustrates a side, half-sectional view of another embodiment of the downhole tool in a run-in configuration.

FIG. 8 illustrates a side, half-sectional view of another embodiment of the downhole tool 100. In this embodiment, the downhole tool 100 may include a seal ring 800, e.g., instead of the seal ring 104 discussed above. The seal ring 800 may include a generally U-shaped cross-sectional profile, with raised axial ends 802, 804 and a recessed middle 806 extending axially therebetween. Further, an inner diameter surface of the seal ring 800 may be tapered, e.g., to slide along the taper of the cone 102. The axial end 804 may face the band 112 and may be driven along the cone 102, resulting in the seal ring 800 being pressed radially outward by a combination of engagement with the band 112 and the cone 102 during setting.

A seal 808 may be positioned on the recessed middle 806, between the axial ends 802, 804 of the seal ring 800. The seal 808 may be bonded with the recessed middle 806 and the axial ends 802, 804. The seal 808 may be formed from a polymeric material, an elastomeric material, or any other suitable sealing material. The seal 808 may, in some embodiments, have a groove 810 formed therein, approximately at the axial middle of the seal 808. The groove 810 may facilitate expansion and sealing with a surrounding tubular (e.g., the tubular 400 of FIG. 4) into which the downhole tool 100 may be deployed and set.

Figure 9:
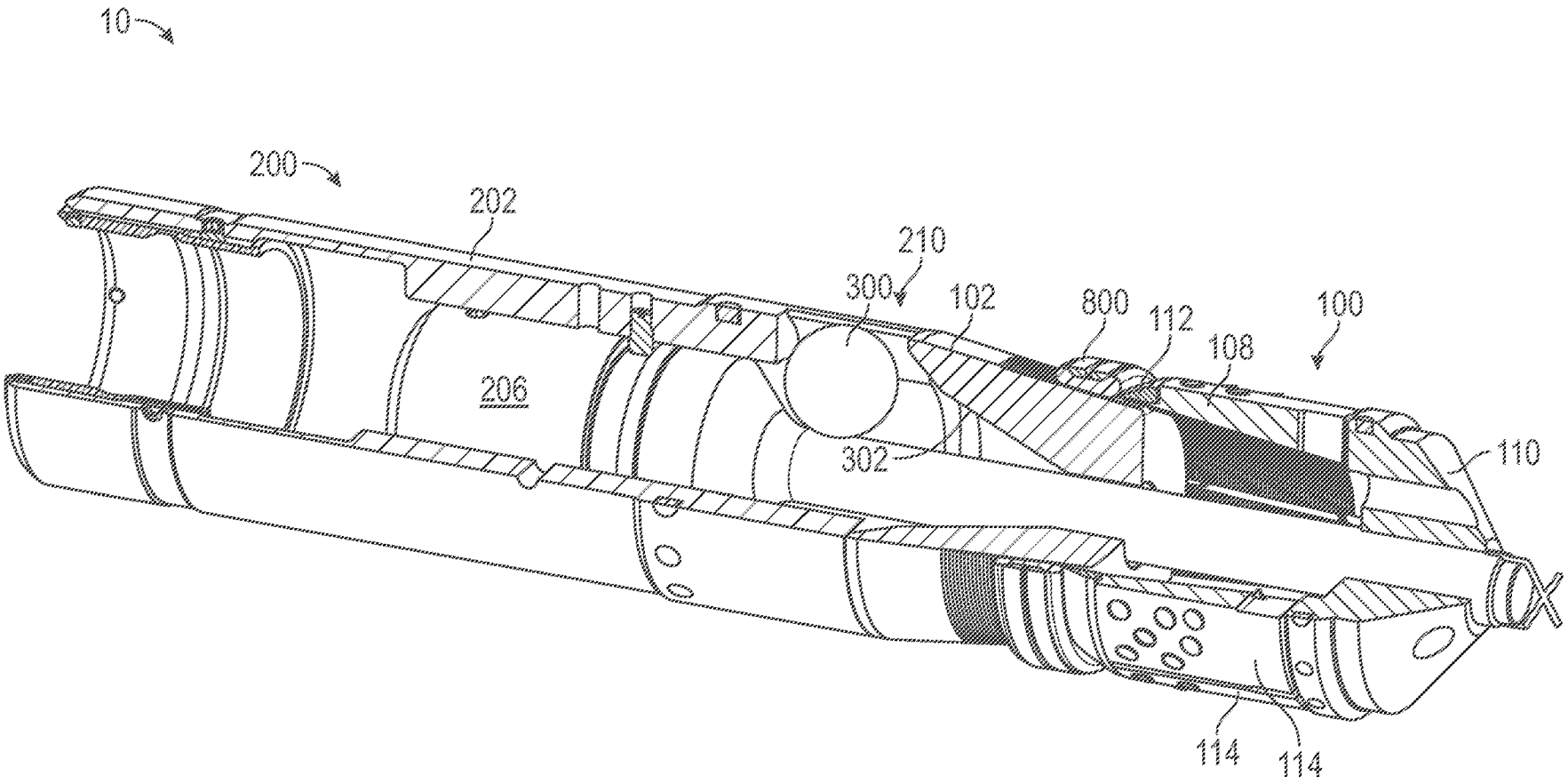
FIG. 9 illustrates a perspective, quarter-sectional view of the downhole tool of FIG. 8, along with a setting tool, according to an embodiment.

This embodiment of the downhole tool 100 may function similarly to the embodiments of FIGS. 1-7. In particular, FIG. 9 illustrates this embodiment of the downhole tool 100 as part of the assembly 10 and in engagement with the setting tool 200. The assembly 10 may be run into a wellbore in the illustrated configuration, until reaching a desired location. At that point, the setting tool 200 may be actuated to push the outer setting sleeve 202 downward, which in turn presses downward on the cone 102. At the same time, the setting rod 206 is pulled upward, which in turn applies an upward-directed force on the slips assembly 108 via engagement with the shoe 110.

Accordingly, the cone 102 is driven into the slips assembly 108. The slips segments 114 eventually break apart and move radially outward so as to anchor with the surrounding tubular, and the seal ring 800 is deformed radially outward and pressed into sealing engagement with the surrounding tubular. Eventually, the shoe 110 and/or setting rod 106 release from engagement with the (remainder of) the downhole tool 100, and the setting tool 200 is withdrawn, leaving at least the slips assembly 108, the cone 102, and the seal ring 800 anchored in place in the surrounding tubular. Further, upon withdrawing the setting tool 200 from engagement with the cone 102, the obstructing member 300 may be released from its storage pocket 210, and received into the valve seat 302 provided by the cone 102, so as to prevent downhole-directed fluid flow past the downhole tool 100.

Figure 10:
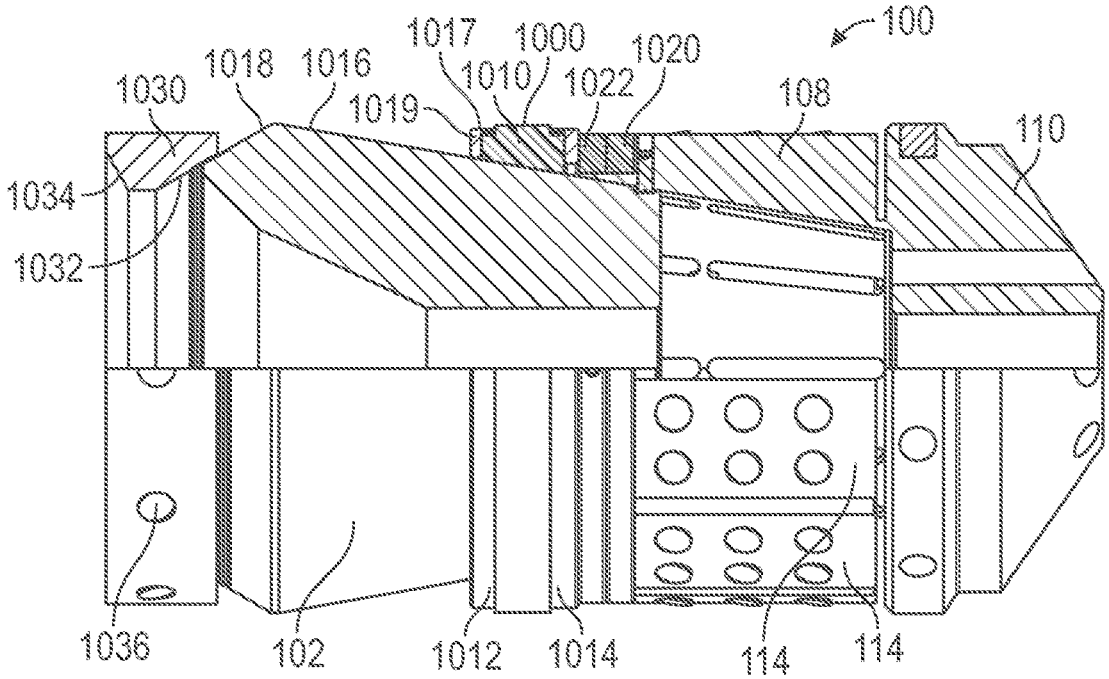
FIG. 10 illustrates a side, half-sectional view of another embodiment of the downhole tool in a run-in configuration, according to an embodiment.

FIG. 10 illustrates a side, half-sectional view of another embodiment of the downhole tool 100. The downhole tool 100 may include a seal ring 1000 rather than the seal ring 104 and/or 800. The seal ring 1000 may include a central sealing element 1010 and two containment rings 1012, 1014 on either axial side of the central sealing element 1010. The central sealing element 1010 may define a stepped profile on either axial end thereof, and the containment rings 1012, 1014 may each include an axially-extending portion 1017 and a radially-extending portion 1019. The containment rings 1012, 1014 may thus be shaped to provide both axial and radial containment of the central sealing element 1010, at least during run-in. In particular, for example, the central sealing element 1010 may be positioned such that at least a portion of the sealing element 1010 is radially between the cone 102 and the axially-extending portions 1017, and axially between the radially-extending portions 1019 of the two containment rings 1012, 1014.

The seal ring 1000 may be positioned on a first taper 1016 of the cone 102. The first taper 1016 also extends into and engages the inside of the slips assembly 108, as discussed above, for purposes of wedging the slips assembly 108 radially outward during setting. The cone 102 may also have a second taper 1018, which may extend at a non-zero (e.g., obtuse) angle to the first taper 1016, as will be described in greater detail below.

As noted above, during setting, an axial force, applied by the setting tool 200 (e.g., FIG. 12), forces the shoe 110 in an uphole direction. Thus, this force is transmitted to the slips assembly 108, which then transmits at least part of this force to the seal ring 1000, such that the slips assembly 108 and the seal ring 1000 are driven along the first taper 1016 of the cone 102 and thereby pressed radially outward. The downhole tool 100 may provide one or more backup rings (two are shown: 1020, 1022), which transmit the axial force between the slips assembly 108 and the seal ring 1000. The backup rings 1020, 1022 may prevent extrusion of the seal ring 1000 between the circumferentially-separated slips segments 114 during setting. The backup rings 1020, 1022 may, in some embodiments, also constrain the slips segments 114 together, similar to the band 112 discussed above, e.g., with reference to FIGS. 1 and 2.

Figure 11:
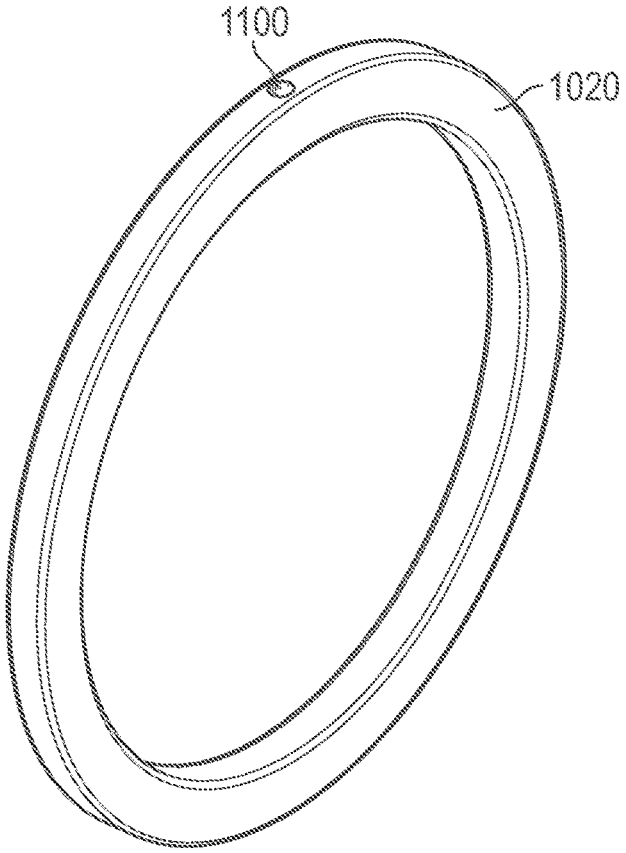
FIG. 11 illustrates a perspective view of a back-up ring of the downhole tool of FIG. 10, according to an embodiment.

The backup rings 1020, 1022 may be more rigid than the seal ring 1000 and may be configured to fracture as they are deformed radially outward by the relative movement of the cone 102 and the slips assembly 108. The backup rings 1020, 1022 may thus provide a preferential fracture point (i.e., a weak spot). The preferential fracture points of the backup ring 1020, 1022 may be circumferentially offset from one another, so as to avoid forming a continuous gap through which the seal ring 1000 may extrude. For example, as shown in FIG. 11, the preferential fracture point may be formed by one or more holes 1100 formed radially through the backup ring 1020 (a similar hole may be provided in the backup ring 1022). The hole 1100 may also receive a shear pin or another member therethrough, which may facilitate proper alignment of the backup rings 1020, 1022 relative to one another. In other embodiments, the preferential fracture point may be formed by a groove, slot, or by otherwise weakening one point of the backup ring 1020, 1022 relative to a remainder of its structure.

Referring again to FIG. 10, the downhole tool 100 may also include a slips ring 1030, which may be positioned at least partially around the second taper 1018 of the cone 102. The slips ring 1030 may also include two tapers 1032, 1034 therein, with the taper 1032 being configured to engage and slide against the second taper 1018 of the cone 102. The slips ring 1030 may also include inserts or "buttons" 1036 made from a carbide, ceramic, or another material that is configured to embed into the (e.g., steel) surrounding tubular into which the downhole tool 100 is deployed. This may permit the remainder of the slips ring 1030 to be made from a relatively soft and/or dissolvable material.

Figure 12:
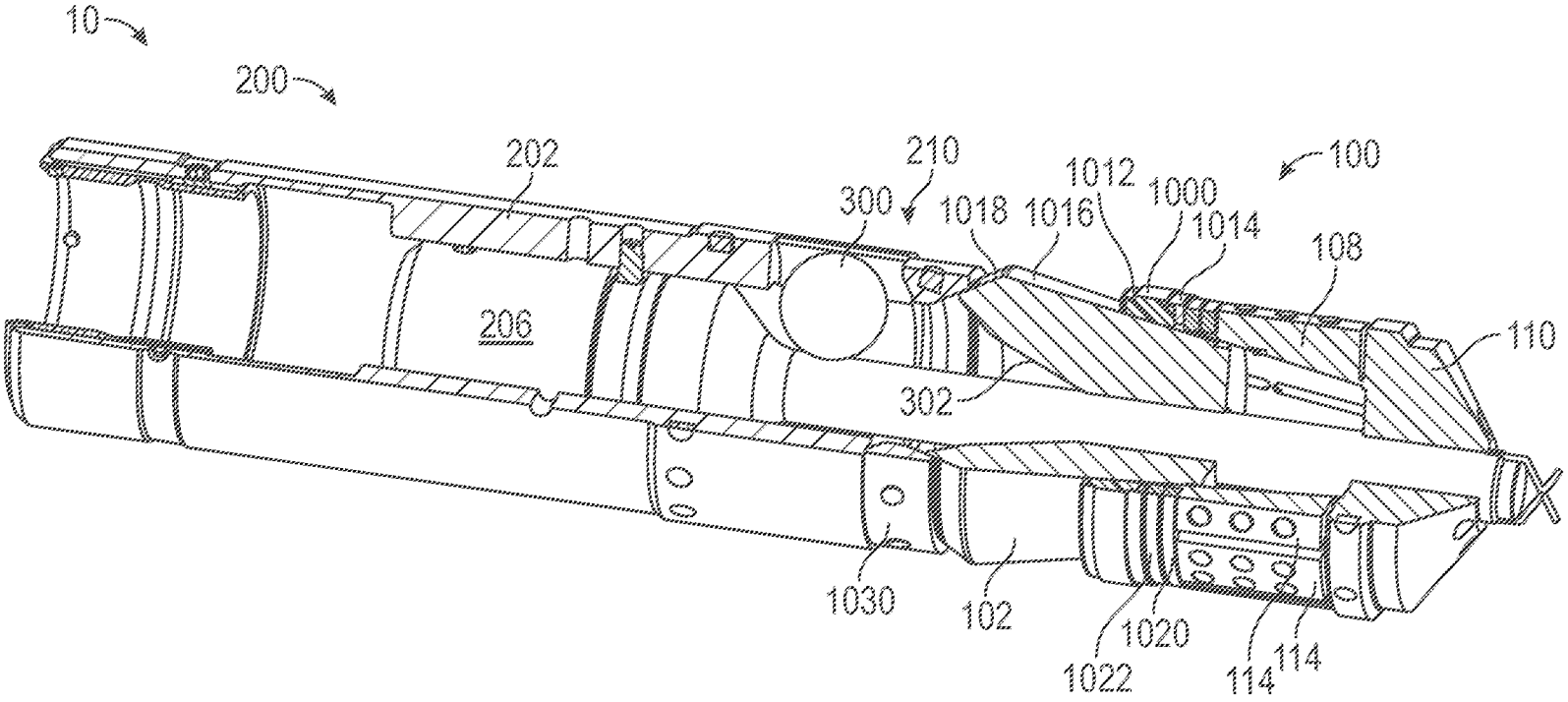
FIG. 12 illustrates a perspective, quarter-sectional view of the downhole tool of FIG. 10, along with a setting tool, according to an embodiment.

Referring now to FIG. 12, there is shown a perspective, quarter-sectional view of the assembly 10 including the downhole tool 100, specifically the embodiment of FIG. 10, as well as the setting tool 200. As shown, the outer setting sleeve 202 presses against the slips ring 1030, and not directly against the cone 102, at least in this embodiment. Accordingly, during setting, the setting sleeve 202 drives the slips ring 1030 axially along the second taper 1018, thereby pressing and deforming the slips ring 1030 radially outward. In other words, the force that drives the cone 102 into the slips assembly 108 is also the force that drives the slips ring 1130 along the cone 102, and thereby causes both sets of anchoring elements (the slips assembly 108 and the slips ring 1030) to be pressed radially outwards. Moreover, as this occurs, the slips ring 1030 may become thinner in radial dimension, as the buttons 1036 are pressed outwards so as to embed at least partially into a surrounding tubular.

During this setting process, the slips assembly 108 may also press the seal ring 1000 axially along the first taper 1016 of the cone 102, e.g., with the force being transmitted through the backup rings 1020, 1022. The containment rings 1012, 1014 may likewise radially and/or axially deform during this process, permitting the central sealing element 1010 to form a fluid-tight seal with the surrounding tubular. Further, the backup rings 1020, 1022 may fracture, so as to permit radial expansion thereof.

Accordingly, the slips ring 1030 and the seal ring 1000 may be forced axially toward one another. In some cases, the slips ring 1030 and the seal ring 1000 may be pressed together during the setting process. In other cases, the slips ring 1030 and the sealing ring 1000 may be axially separated apart when the downhole tool 100 is fully set. In some embodiments, the slips ring 1030 may be prevented from moving past the second taper 1018 and onto the first taper 1016.

Figure 13:
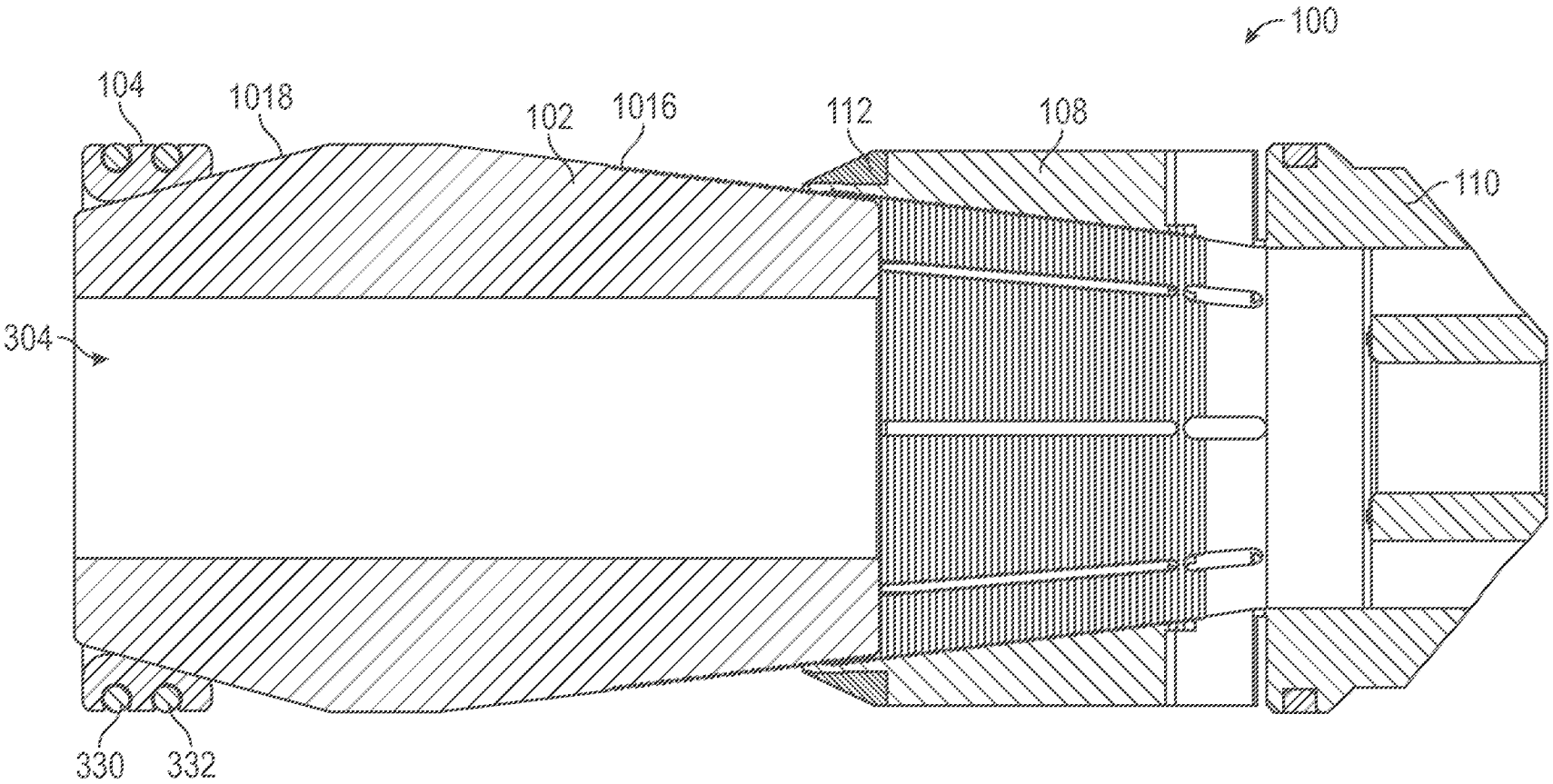
FIG. 13 illustrates a side, cross-sectional view of another embodiment of the downhole tool in a run-in configuration.

FIG. 13 illustrates a side, cross-sectional view of another embodiment of the downhole tool 100. This embodiment may include the seal ring 104, similar to the embodiment of FIG. 3; however, the seal ring 104 in this embodiment may be located on the second taper 1018 of the cone 102. The inner diameter surface of the seal ring 104 in this embodiment may thus be tapered reverse to the seal ring 104 of FIG. 3, so that the seal ring 104 is configured to slide along the second taper 1018. The second taper 1018 in this embodiment may be more gradual (smaller angle with respect to a central axis) than the second taper 1018 of the embodiment of FIGS. 11 and 12. Further, in this embodiment, the seal ring 104 may include the o-ring seals 330, 332, which may be pressed outward into sealing engagement with a surrounding tubular. In another embodiment, the seal ring 800 or the seal ring 1000 may be used on the downhole tool 100 shown in FIG. 13 in place of the seal ring 104.

The seal ring 104 may be configured to directly engage the outer setting sleeve 202 of the setting tool 200 (e.g., FIG. 2). Accordingly, in at least some embodiments, the axial force applied by the setting sleeve 202 to the cone 102 may be applied thereto via the seal ring 104, and the seal ring 104 may not directly engage the band 112 and/or any other component of the slips assembly 108. Thus, the axial force that causes the seal ring 104 to move radially outward and seal with the surrounding tubular is also the force that causes the cone 102 to move into and force the slips assembly 108 radially outwards, to anchor the tool 100 in the surrounding tubular. Moreover, at least in the illustrated embodiment, the slips ring 1030 is omitted, even though the cone 102 has dual tapers. Although not shown, the bore 304 of the cone 102 may be contoured to provide a valve seat (similar to the valve seat 302 of FIG. 3) that may receive an obstruction member.

Figure 14:
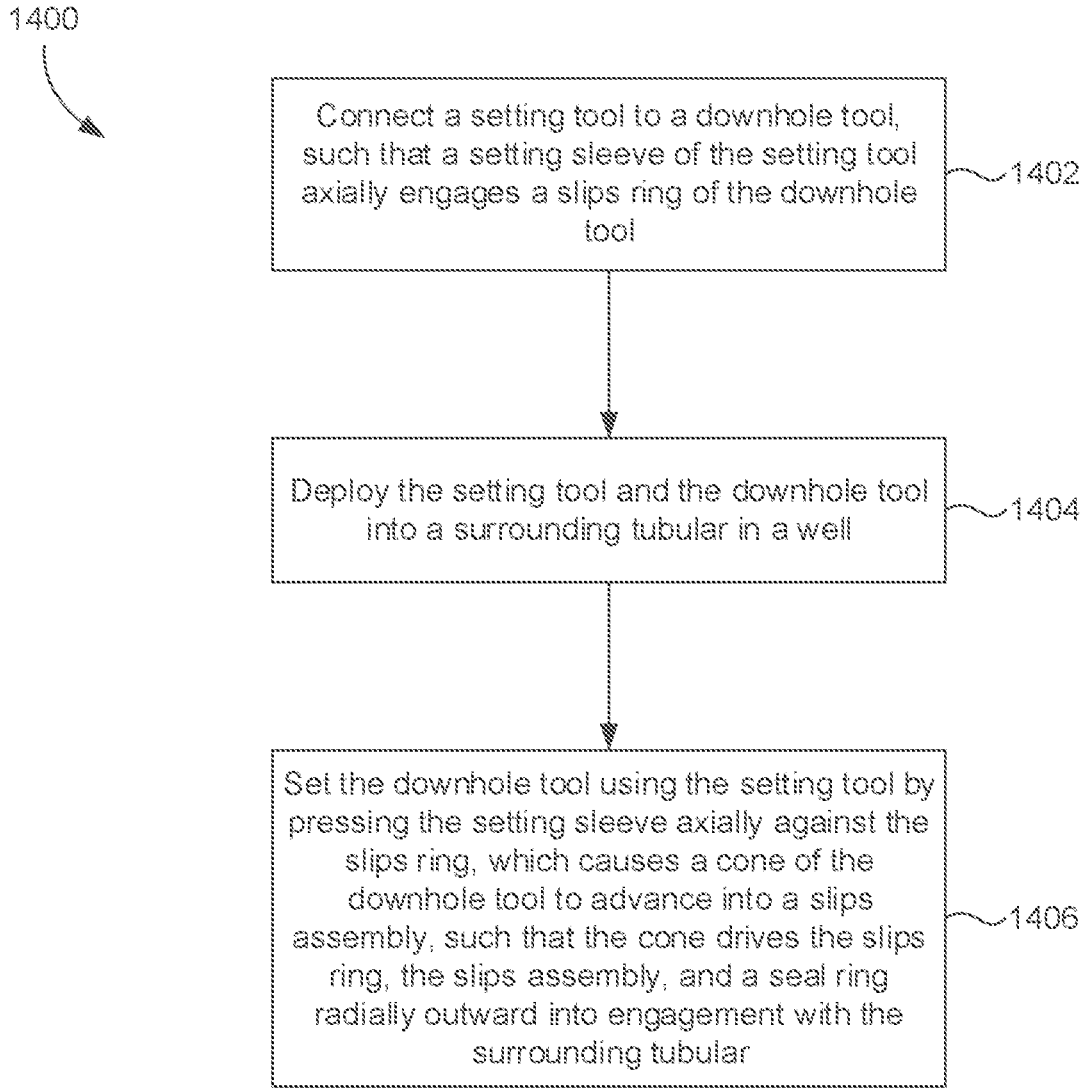
FIG. 14 illustrates a flowchart of a method, according to an embodiment.

FIG. 14 illustrates a flowchart of a method 1400, e.g., for using a downhole tool such as an embodiment of the downhole tool 100 discussed above, according to an embodiment. In particular, the method 1400 may be considered in view of the embodiments of FIGS. 10-12, although this is merely one example. Further, the steps of the method 1400 may be performed in any order, may be combined, partitioned, separated, and/or conducted in parallel or in sequence, without departing from the scope of the present disclosure.

The method 1400 may include connecting a setting rod 206 of a setting tool 200 to a shoe 110 of a downhole tool 100, as at 1402. When the setting tool 200 is connected to the downhole tool 100, a setting sleeve 202 of the setting tool 200 may engage a slips ring 1030 of the downhole tool 100. In an embodiment, the slips ring 1030 is positioned around a cone 102 of the downhole tool 100.

The method 1400 may also include deploying the setting tool 200 and the downhole tool 100 into a surrounding tubular (e.g., a casing, liner, or wellbore wall) in a well, as at 1404. Once the setting tool 200 and the downhole tool 100 have reached a desired setting location in the well, the method 1400 may include setting the downhole tool 100 in the well using the setting tool 200. In an embodiment, setting the downhole tool 100 may include pressing a first taper 1016 of the cone 102 into a slips assembly 108 of the downhole tool 100 by applying a force to the slips ring 1030, e.g., by pressing the setting sleeve 202 axially against the slips ring 1030. Applying the force to the slips ring 1030 drives the cone 102 to advance farther into the slips assembly 108, which in turn causes the first taper 1016 of the cone 102 to press the slips assembly 108 radially outward, so as to set the slips assembly 108 against the surrounding tubular. Further, applying the force causes the slips ring 1030 to slide along a second taper 1018 of the cone 102, toward the slips assembly 108, so as to press the slips ring radially outward.

In an embodiment, a seal ring 1000 is also pressed radially outward, e.g., by axial engagement with the slips assembly 108 (via backup rings 1020, 1022) while the cone 102 advances farther into the slips assembly 108. In a specific embodiment, the seal ring 1000 may be positioned around the first taper 1016 of the cone 102, such that advancing the cone 102 causes the first taper 1016 to advance relative to the seal ring 1000, resulting in the seal ring 1000 being pressed (e.g., deformed) radially outward into sealing engagement with the surrounding tubular.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a slips assembly;

a cone positioned at least partially within the slips assembly, wherein the cone is configured to move axially relative to the slips assembly such that the cone presses the slips assembly radially outward and into engagement with a surrounding tubular in which the downhole tool is deployed;

a seal ring positioned around the cone, wherein the seal ring is configured to be pressed radially outward by engagement with the cone and into engagement with the surrounding tubular; and a slips ring positioned at least partially around the cone, the slips ring being configured to be pressed radially outward by engagement with the cone and into engagement with the surrounding tubular, wherein the cone comprises a first taper that extends into the slips assembly and around which the seal ring is positioned, and a second taper around which the slips ring is positioned, the first and second tapers defining a non-zero angle therebetween, and wherein the slips ring is configured to directly engage a setting sleeve that is configured to force the cone to advance axially into the slips assembly, wherein the seal ring is configured to engage the slips assembly, and wherein the setting sleeve advancing the cone axially into the slips assembly causes the seal ring and the slips ring to move axially toward one another and to be deformed radially outward.

2. The tool of claim 1, further comprising a shoe secured to the slips assembly, wherein the shoe breaks apart from the slips assembly when the slips assembly is pressed radially outward into the surrounding tubular, and wherein the cone comprises a bore therethrough, the bore defining a valve seat for receiving an obstructing member so as to seal the bore and prevent fluid flow through the downhole tool.

3. The tool of claim 2, wherein the shoe comprises a plurality of inserts therein, the inserts extending to a position that is radially outward of the slips assembly, wherein the inserts are formed from a material that is harder than a material from which at least a portion of the slips assembly is formed.

4. The tool of claim 1, wherein the slips ring comprises a plurality of inserts configured to embed at least partially into the surrounding tubular, to anchor the tool in the surrounding tubular.

5. The tool of claim 1, further comprising a first backup ring and a second backup ring, the first and second backup rings being positioned around the cone and axially between the seal ring and the slips assembly, wherein the slips assembly is configured to transmit an axial force to the seal ring via the first and second backup rings.

6. The tool of claim 1, wherein the seal ring comprises a first containment ring, a second containment ring, and a central sealing element positioned between the first and second containment rings.

7. The tool of claim 6, wherein the first and second containment rings each include an axially-extending portion and a radially-extending portion, and wherein the central sealing element defines a stepped profile configured to be received radially at least partially between the cone and the axially-extending portions of the first and second containment rings, and axially at least partially between the radially-extending portions of the first and second containment rings.

8. The tool of claim 1, wherein the slips assembly comprises:

a plurality of slips segments that are circumferentially adjacent to one another; and a band positioned around the plurality of slips segments and being configured to hold the plurality of slips segments together until the cone presses the slips assembly radially outwards, wherein the band is configured to deform or yield in response to the cone pressing the slips assembly radially outwards, wherein the band axially engages the seal ring.

9. The tool of claim 8, wherein the band is wedge-shaped, such that axial engagement of the seal ring against the band causes the seal ring to press against the surrounding tubular.

10. The tool of claim 1, wherein the seal ring comprises one or more elastomeric o-rings on an outer surface thereof.

11. A downhole tool, comprising:

a slips assembly;

a cone positioned at least partially within the slips assembly, wherein the cone is configured to move axially relative to the slips assembly such that the cone presses the slips assembly radially outward and into engagement with a surrounding tubular in which the downhole tool is deployed;

a seal ring positioned around the cone, wherein the seal ring is configured to be pressed radially outward by engagement with the cone and into engagement with the surrounding tubular; and a first backup ring and a second backup ring, the first and second backup rings being positioned around the cone and axially between the seal ring and the slips assembly, wherein the slips assembly is configured to transmit an axial force to the seal ring via the first and second backup rings, wherein the first and second backup rings each define a preferential fracture location, the preferential fracture locations of the first and second backup rings being circumferentially offset from one another.

12. An assembly, comprising:

a downhole tool, comprising:

a slips assembly;

a cone received at least partially into the slips assembly, wherein the cone is tapered such that moving the cone relative to the slips assembly causes the cone to press the slips assembly radially outward into engagement with a surrounding tubular into which downhole tool is deployed;

a seal ring received around the cone, wherein the seal ring is configured to be pressed radially outward into engagement with the surrounding tubular by engagement with the cone; and a slips ring positioned at least partially around the cone, the slips ring being configured to be pressed radially outward by engagement with the cone and into engagement with the surrounding tubular, wherein the cone comprises a first taper that extends into the slips assembly and around which the seal ring is positioned, and a second taper around which the slips ring is positioned, the first and second tapers defining a non-zero angle therebetween; and a setting tool comprising a setting sleeve that is configured to apply an axial force onto the downhole tool that forces the cone to advance axially into the slips assembly, so as to press the slips assembly and the seal ring radially outward into engagement with the surrounding tubular wherein the slips ring is configured to directly engage the setting sleeve, wherein the seal ring is configured to engage the slips assembly, and wherein the setting sleeve advancing the cone axially into the slips assembly causes the seal ring and the slips ring to move axially toward one another and to be deformed radially outward.

13. The assembly of claim 12, wherein:

the downhole tool further comprises a shoe that is secured to the slips assembly;

the setting tool further comprises a setting rod that extends through the downhole tool and is connected to the shoe, and an obstruction member retained within the setting sleeve by the setting rod; and the obstruction member is received into a valve seat of the cone when the setting tool is disengaged from the downhole tool.

14. The assembly of claim 13, wherein the setting sleeve comprises:

an enlarged diameter section, the enlarged diameter section being sized to accommodate the obstruction member at least partially therein; and a plurality of inserts positioned at least partially in the enlarged diameter section and extending radially outward so as to protect the downhole tool from engagement with the surrounding tubular during run-in.

15. The assembly of claim 12, wherein the setting sleeve does not directly engage the cone, and wherein forcing the cone to advance axially into the slips assembly moves the slips ring and the seal ring axially toward one another.

16. The assembly of claim 12, wherein the setting sleeve directly engages the cone and is configured to force the cone to advance axially into the slips assembly, so as to press the seal ring and the slips assembly radially outwards.

* * * * *